US007048442B2

(12) United States Patent
Schneider et al.

(10) Patent No.: US 7,048,442 B2
(45) Date of Patent: May 23, 2006

(54) RECLOSABLE PACKAGING FOR SCOOPABLE PRODUCTS AND METHOD OF MANUFACTURE

(75) Inventors: John H. Schneider, Frankfort, IL (US); Steven Ausnit, New York, NY (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/145,550

(22) Filed: May 15, 2002

(65) Prior Publication Data

US 2003/0215163 A1 Nov. 20, 2003

(51) Int. Cl.
*B65D 33/16* (2006.01)

(52) U.S. Cl. ..... 383/61.2; 383/63; 383/203; 383/207; 383/210; 383/65

(58) Field of Classification Search ..... 383/61.2, 383/63, 64, 203, 65, 207, 210, 211
See application file for complete search history.

(56) References Cited

U.S. PATENT DOCUMENTS 3,282,493 A * 11/1966 Kamins et al. ..... 383/203
4,191,230 A * 3/1980 Ausnit ..... 383/61.2
4,713,839 A * 12/1987 Peppiatt ..... 383/29
4,840,611 A 6/1989 Van Erden et al.
4,877,336 A * 10/1989 Peppiatt ..... 383/8
4,896,775 A * 1/1990 Boeckmann et al. ..... 206/557
4,925,316 A * 5/1990 Van Erden et al. ..... 383/210.1
5,063,639 A * 11/1991 Boeckmann et al. .... 24/30.5 R
5,121,997 A 6/1992 La Pierre et al.
5,709,479 A * 1/1998 Bell ..... 383/209
5,749,822 A 5/1998 Ellsworth et al.
5,826,401 A * 10/1998 Bois ..... 53/412
6,115,892 A 9/2000 Malin et al.
6,138,436 A 10/2000 Malin et al.
6,138,439 A 10/2000 McMahon et al.
6,178,722 B1 1/2001 McMahon
6,185,907 B1 2/2001 Malin et al.
6,186,663 B1 2/2001 Ausnit
6,257,763 B1 * 7/2001 Stolmeier et al. ..... 383/5
6,308,498 B1 10/2001 Malin et al.
6,325,543 B1 12/2001 Ausnit
6,327,837 B1 12/2001 Van Erden
6,477,821 B1 * 11/2002 Bois ..... 53/412
6,481,890 B1 * 11/2002 VandenHeuvel ..... 383/64
6,499,878 B1 * 12/2002 Dobreski et al. ..... 383/5

(Continued)

FOREIGN PATENT DOCUMENTS

EP 000528721 A * 2/1993 ..... 383/63

(Continued)

*Primary Examiner*—Jes F. Pascua
(74) *Attorney, Agent, or Firm*—Ostrager Chomg Flaherty & Broitman P.C.

(57) ABSTRACT

A reclosable package for scoopable products, such as flour and detergent. The package has a closed plastic zipper installed in a gusset. The gusset comprises first and second panels connected at a fold line. The zipper comprises first and second zipper portions respectively joined to the first and second gusset panels. In one embodiment, the zipper portions are connected by a fold line situated adjacent the gusset fold line. In another embodiment, the zipper portions are connected by a fold line situated away from the gusset. In a third embodiment, the zipper portions are not connected prior to opening the package along the gusset fold line. A peel seal is placed between the zipper portions and above the interlocked profiled closure elements of the zipper.

6 Claims, 4 Drawing Sheets

U.S. PATENT DOCUMENTS 6,530,870 B1 3/2003 Buchman et al.
6,604,651 B1 * 8/2003 Amundson et al. ..... 221/47
6,666,580 B1 * 12/2003 Bois ..... 383/61.2

FOREIGN PATENT DOCUMENTS

FR 1 551 228 * 11/1968 ..... 383/61.2

* cited by examiner

RECLOSABLE PACKAGING FOR SCOOPABLE PRODUCTS AND METHOD OF MANUFACTURE

BACKGROUND OF THE INVENTION

This invention generally relates to reclosable packaging for containing powder or other granular or particulate matter. More particularly, it relates to reclosable packages for containing powder that are gusseted.

In the use of plastic bags, pouches and other packages, particularly for containing foodstuffs, it is important that the bag be hermetically sealed until the purchaser acquires the bag and its contents, takes them home, and opens the bag or package for the first time. It is then commercially attractive and useful for the consumer that the bag or package be reclosable so that its contents may be protected. Flexible plastic zippers have proven to be excellent for reclosable bags, because they may be manufactured with high-speed equipment and are reliable for repeated reuse.

A typical zipper has a pair of opposing zipper portions formed by extrusion. The zipper portions are extruded with respective interlockable profiles that can be interlocked when opposing sides of the mouth of the bag are pressed together. The profiles in plastic zippers can take on various well-known configurations, e.g. interlocking ribs and grooves, interlocking elements having so-called male and female profiles, interlocking alternating hook-shaped closure elements, etc. In the last case, there may be no difference in appearance between the opposing closure elements. The zipper portions are joined in some manner to the material from which the bags themselves are manufactured. Sometimes the zipper portions are provided with respective extension flanges to which the uppermost portions of the front and rear walls of the bag are joined. In addition, the zipper portions may be provided with pull flanges, which are gripped by the user to pull open the zipper.

Although flexible zippers of this variety are quite popular, they do not always prevent the inadvertent or unwelcome opening of a bag or package within the store; and various additions have been made to provide tamper-evident seals that would reveal when it has been opened prior to purchase. It is known to provide a zipper package construction that is designed to undergo some permanent change in the package appearance when the package is opened for the first time. In particular, it is known to provide a zipper package with a tamper-evident, non-reclosable peel seal that gives a positive indication of having been broken when a package is first opened.

Such zipper package constructions should also have other desirable features. For example, the package should be "user friendly" in the sense that the steps necessary for the initial opening of the package prior to the use of the zipper are obvious or intuitive to the consumer and easy to perform. Also the zipper package design should allow the package to be formed on conventional packaging equipment with little or no modification of the equipment being required. In cases where the package contents require hermetic sealing, it is desirable that the tamper-evident feature also permit such hermetic sealing.

There is a need for a reclosable package suitable for containing scoopable powdery products such as flour and detergent. Such a package should have a zippered mouth configured and disposed so that insertion of a scoop into the package is facilitated. The package should also include a hermetic seal and an easy-open feature

BRIEF DESCRIPTION OF THE INVENTION

The invention is directed to reclosable packages for scoopable products, such as flour and detergent, and methods for manufacturing such packages. The package has a design that facilitates consumer scooping of a powder or other granular matter. Further optional features include a hermetic seal and an easy-open feature.

One aspect of the invention is a package having a closed plastic zipper installed in a gusset. The gusset comprises first and second panels connected at a fold line. The zipper comprises first and second zipper portions respectively joined to the first and second gusset panels. In one embodiment, the zipper portions are connected by a fold line situated adjacent the gusset fold line. In another embodiment, the zipper portions are connected by a fold line situated away from the gusset. In a third embodiment, the zipper portions are not connected prior to opening the package along the gusset fold line. A peel seal can be placed between the zipper portions and above the interlocked profiled closure elements of the zipper.

Another aspect of the invention is a package comprising web material forming a receptacle defining an interior volume, the receptacle comprising a gusset comprising first and second gusset panels that meet at a fold line; and a flexible zipper comprising a first zipper portion joined to the first gusset panel and a second zipper portion joined to the second gusset panel. Each of the first and second zipper portions comprises at least one profiled closure element, the zipper portions being interlocked by those closure elements.

Yet another aspect of the invention is a method of manufacturing a reclosable package, comprising the following steps: (a) forming an unfolded zipper comprising first and second interlockable profiled closure elements; (b) joining the unfolded zipper to bag material; (c) forming the bag material into a tubular shape having an axis; (d) folding the zipper and adjoining portions of the bag material to form a gusset that enfolds at least a portion of the folded zipper; and (e) cross sealing the bag material along a line extending generally transverse to said axis to form a receptacle.

Another aspect of the invention is a method of manufacturing a reclosable package, comprising the following steps: extruding first and second zipper parts onto a carrier web, the first and second zipper parts respectively comprising first and second interlockable profiled closure elements; stripping the first and second zipper parts off of the carrier web; joining the first and second zipper parts to bag material; forming the bag material into a tubular shape having an axis; folding the portions of bag material to which the first and second zipper parts are joined to form a gusset; interlocking the first and second interlockable profiled closure elements of the first and second zipper parts; and cross sealing the bag material along a line extending generally transverse to the axis to form a receptacle.

A further aspect of the invention is a package comprising web material defining a receptacle comprising first and second walls and a third wall connected to the first and second walls at first and second fold lines respectively, the third wall having a third fold line; and a flexible zipper comprising a first zipper portion joined to a first area of the third wall and a second zipper portion joined to a second area of the third wall. In one embodiment, the first and second zipper portions are connected at a fold line disposed adjacent the third fold line. In another embodiment, the first and second zipper portions are connected at a fold line disposed at a distance away from the receptacle.

Other aspects of the invention are disclosed and claimed below.

DETAILED DESCRIPTION OF THE INVENTION

Figure 1:
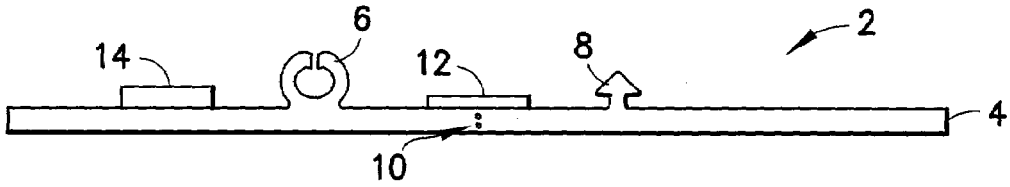
FIG. 1 is a schematic showing a cross-sectional view of one embodiment of a zipper that can be employed in the reclosable packages disclosed herein.

Reference will now be made to the drawings, in which similar elements in different drawings bear the same reference numerals. The reclosable packages disclosed herein are made using pre-made zipper tape that is joined to the mouth of the package, as will be described in more detail later.

The cross-sectional structure of one suitable zipper tape 2 is depicted in FIG. 1. The zipper tape 2 comprises a planar base strip 4, a closure element 6 having a female profile and a closure element 8 having a male profile. The male and female profiles are designed to interlock when the zipper is folded. Male closure element 8 comprises a shaft extending perpendicularly from the planar base strip 4. The shaft terminates with an enlarged head having outwardly pointing detents for engaging the C-shaped female closure element 6. The female closure element comprises a pair of legs extending up from the base strip 4 on the same side as the male closure element. The legs of the female closure element terminate in inwardly pointing detents for releasably engaging respective detents of the enlarged head of the male profile.

Interlocking rib and groove elements are well known in the art and many configurations of rib and groove elements may be employed to perform any one of a number of required functions. For instance, specific rib and groove elements may be employed to permit the package to be more easily opened from the outside than from the inside, so that the tension produced by the contents of the package will not accidentally open the rib and groove elements.

Still referring to FIG. 1, the planar base 4 is optionally perforated along a centerline, the perforations being indicated by reference numeral 10. The central perforated area in the base strip 4 is capped by a thin strip 12 of sealing material (hereinafter "cap 12"). Cap 12 hermetically seals the line of perforations 10 in the base strip 4. In addition, a strip 14 of peel seal material is joined to the base strip along a base strip portion lying between the female closure element 6 and the edge of the base strip nearest to the female closure element. The base strip, closure elements, cap and peel seal material are made of thermoplastic materials. For example, the base strip and closure elements can be made from low-density polyethylene (LDPE), while the peel seal material can comprise a blend of LDPE and polybutylene. The sealing strip or cap can be made of saran or EVOH.

Alternatively, the base strip 4 may comprise two or more layers of thermoplastic material, chosen for their advantageous sealing and manufacturing properties. For example, the base strip may comprise a heat-resistant layer, preferably of EAA or EVA, on the top and a sealing layer, preferably of LDPE having a low melting temperature, on the bottom. During heat sealing of the zipper to a thermoplastic bag, the bottom layer will be in contact with the bag material. The sealing layer facilitates sealing the zipper to the bag material.

The walls of the package may be formed of various types of thermoplastic material, such as low-density polyethylene, substantially linear copolymers of ethylene and a C3–C8 alpha-olefin, polypropylene, polyvinylidene chloride, mixtures of two or more of these polymers, or mixtures of one of these polymers with another thermoplastic polymer. The person skilled in the art will recognize that this list of suitable materials is not exhaustive.

In addition, although the zipper tape can be fused directly to the walls of the packaging material, this is not necessary to practice of the present invention. For example, the zipper could be attached to the wall panels of the pouch, bag or other package by means of intermediate thermoplastic bonding strips or by means of adhesive.

The zipper tape depicted in FIG. 1 can be manufactured using conventional extrusion techniques. In particular, the zipper tape can be manufactured by extrusion through a die plate fed by an extruder. As is well known in the art, the die plate includes an input port, an output port, and a channel connecting the input port to the output port. The extruder feeds the molten thermoplastic material to the input port. The output port is arranged such that the molten material exits the die plate with the profile shown in FIG. 1. The zipper extrudate is deposited on a carrier web. The die plate has two additional input ports fed by two additional extruders, and two additional output ports communicating with the respective input ports via respective channels. The second extruder contains molten peel seal material while the third extruder contains molten sealing material. The molten peel seal material is deposited, via the second output port, onto the zipper extrudate between the female closure element and the nearest edge, while the molten sealing material is deposited, via the third output port, onto the central portion of the zipper extrudate, as shown in FIG. 1. Alternatively, the peel seal material can be deposited between the male closure element and the zipper edge nearest to the male closure element, or the peel seal material could be deposited in both places at locations that will be opposed when the zipper is folded. After extrusion, the zipper extrudate with peel seal material and sealing material deposited thereon is cooled, e.g., by spraying water from a nozzle. The resulting zipper tape is then stripped off of the carrier web, continuously perforated along a centerline (optional), and wound onto a spool. Later the zipper tape will be unwound from the spool and applied to bag material, as described below.

Figure 2:
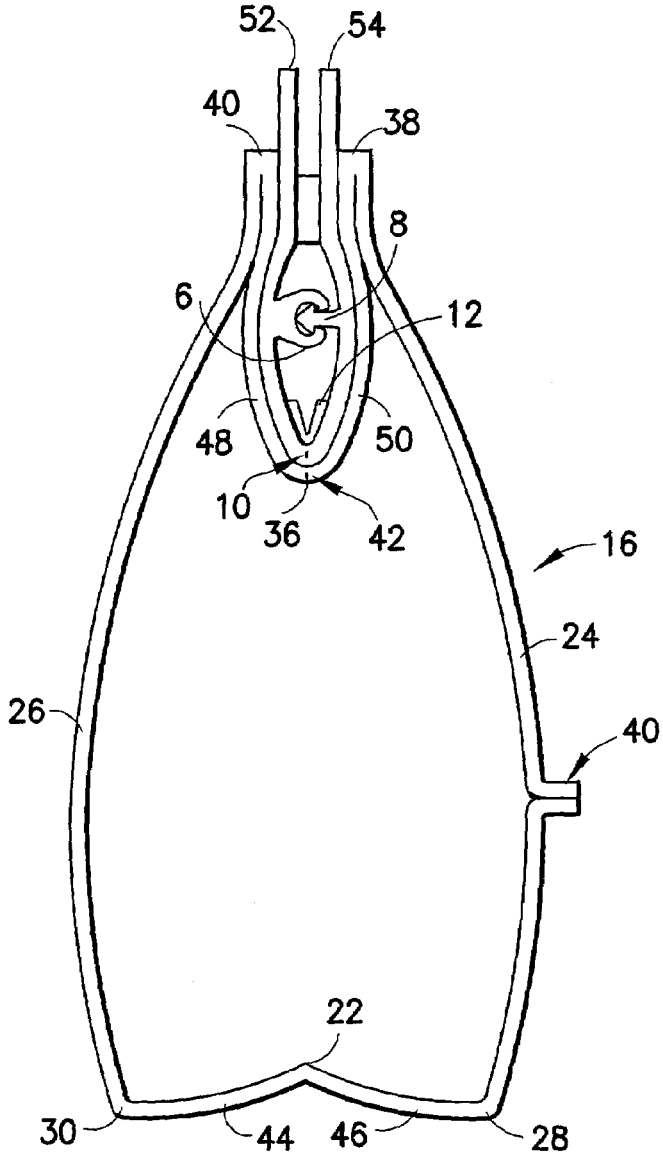
FIGS. 2 and 3 are schematics showing cross-sectional views of one embodiment of a reclosable package. The package is shown in FIG. 2 in a closed state and in FIG. 3 in an open state.
Figure 3:
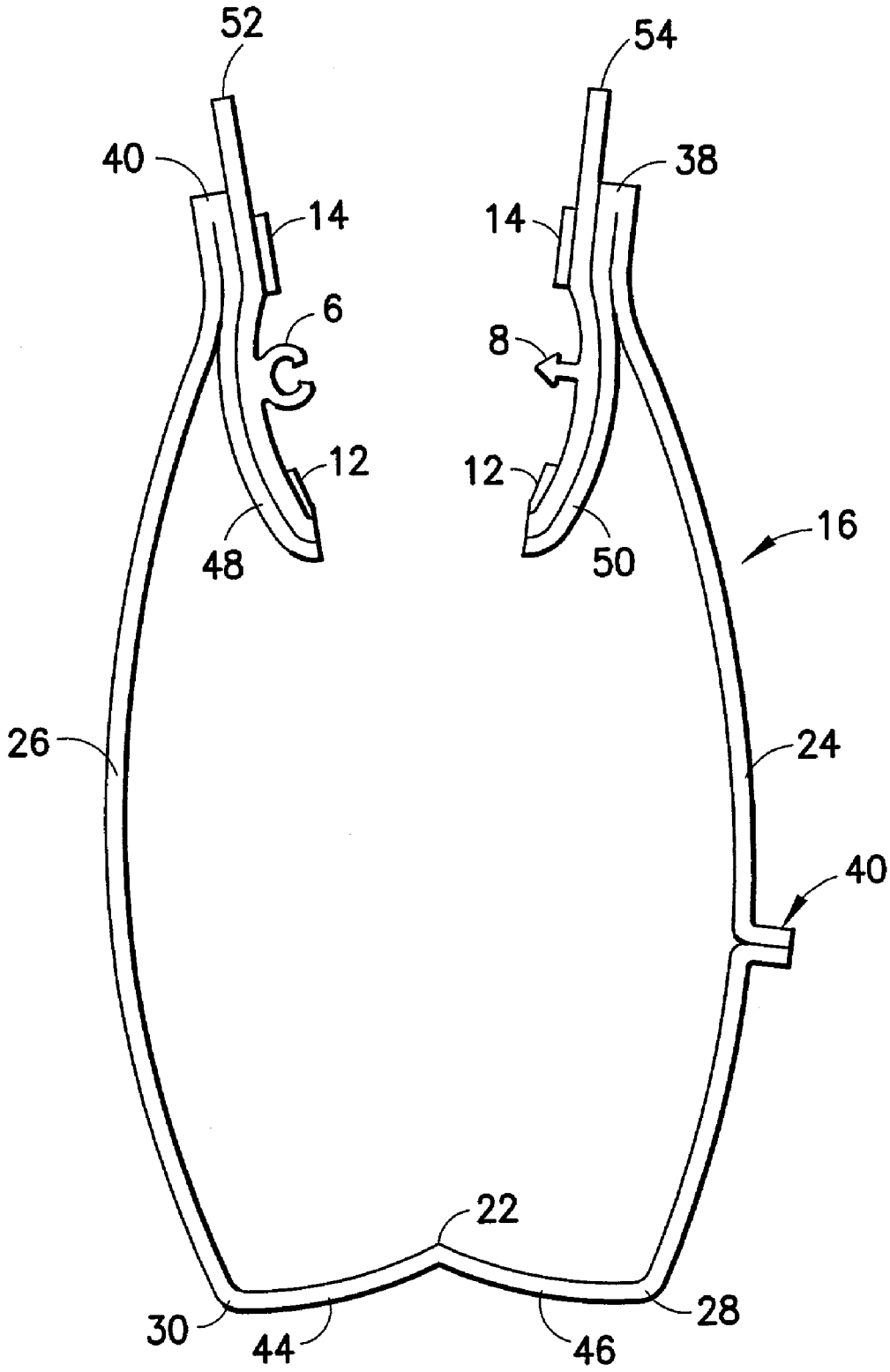

Two sectional views of a gusseted package 16 in accordance with one embodiment of the invention are presented in FIGS. 2 and 3. The package 16 comprises front and rear wall panels 24 and 26 that are sealed at the sides by cross seals (not shown). The package has a gusset at the top and another gusset at the bottom of the package. Each gusset comprises a pair of gusset panels that are connected at a central fold line. More specifically, the bottom gusset comprises gusset panels 44 and 46 joined at a fold line 22, while the top gusset comprises gusset panels 48 and 50 joined at a fold line 36. The gusset panels are in turn connected to the front and rear wall panels 24 and 26 by respective fold lines. For example, gusset panel 46 of the bottom gusset is connected to the rear wall panel 24 by a fold line 28, while gusset panel 44 of the bottom gusset is connected to the front wall panel 26 by a fold line 30. Similarly, gusset panel 50 of the top gusset is connected to the rear wall panel 24 by a fold line 38, while gusset panel 48 of the top gusset is connected to the front wall panel 26 by a fold line 40. When the package is empty and closed, each gusset will be folded inward. FIGS. 2 and 3 seek to show the bottom gusset when the interior volume of the receptacle is filled with powder or other particulate matter (not shown). Assuming, for the sake of illustration, that the package is sitting on a planar surface (not shown), the weight of the package contents will cause the majority of the bottom gusset to flatten, in which event the majority of the central fold line 22 will be co-planar with the fold lines 28 and 30. Near the side seals, however, the gusset material along the central fold line 22 is supported by the side seals, so that the central fold line 22 rises to an elevation above the planar surface near the side seals. Each gusset may comprise a pair of contiguous gusset panels, each panel having the shape of a rectangular strip, the opposing ends of each gusset panel being captured in the side seals.

A zipper of the type depicted in FIG. 1 is installed in the top gusset 18 of the package shown in FIGS. 2 and 3. Like the gusset panels, the ends of the zipper are also captured in the side seals in conventional manner. The arrangement of the zipper relative to the package is clearly shown in FIGS. 2 and 3, in which, for the sake of clarity, the structure behind the section plane is not depicted. Nor are the contents of the package depicted.

In contrast to the zipper configuration shown in FIG. 1, the zipper in FIG. 2 is shown in a folded state with opposing sections of the base strip 4 sealed by the peel seal material 14 and with the male and female closure elements 6 and 8 interlocked. One half of the base strip 4 is joined to gusset panel 48 of the top gusset, while the other half of the base strip 4 is joined to gusset panel 50 of the top gusset. The gusset panels 48 and. 50 are connected at a central fold line 36 (as previously described). Optionally, the fold line 36 is a line of weakness in the bag material. This can be accomplished, for example, by providing perforations (generally designated by numeral 42 in FIG. 2) at spaced intervals along the central fold line 36. Alternatively, the line of weakness could be formed by a score line.

While the majority of the base strip 4 of the zipper is joined to the panels of the top gusset, the terminal portions of the base strip are not. The base strip has a length such that the terminal portions of the base strip extend beyond the top gusset fold lines 38 and 40. Thus, when the zipper tape (and adjoining gusset) is folded along the line of perforations 10 and the male and female profiles are interlocked, as shown in FIG. 2, the terminal portions of the base strip of the zipper will project out of the top gusset, thereby forming pull flanges 52 and 54. In a separate operation, the peel seal material 14 is activated to form a peel seal. In the configuration shown in FIG. 2, the central fold lines in the base strip 4 and the top gusset have respective lines of perforation, i.e., perforations 10 in the base strip and perforations 42 in the top gusset. The line of perforations 10 is generally aligned with the line of perforations 42 and allow the zipper and gusset to be readily torn open. Opening of the package is facilitated by the pull flanges 52 and 54.

To open the package, first the pull flanges 52 and 54 are pried apart to an extent that the peel seal material 14 is ruptured. When the peel seal is broken, the pull flanges 52 and 54 can then be pulled apart until the male closure element 8 disengages from the female closure element 6. Finally the two sides of the zipper are forced or pulled apart, causing the base strip and the top gusset to rupture along their lines of perforation, as shown in FIG. 3. At the same time, the cap 12, comprising a thin layer of sealing material, is also torn asunder. This operation results in the zipper being split into respective zipper parts, except at the side seals, where the zipper ends have been stomped (e.g., ultrasonically) together.

As seen in FIG. 3, the mouth of the package can be opened wide to allow access by a scoop into an interior volume filled with scoopable product, such as flour or detergent. In the case where the bag material is a laminate with a nonsealable inner layer, the gusset panels 48, 50 of the top gusset will not be sealed to the front and rear wall panels 24, 26 during heat sealing, so that the wall panels are free to flex outward without being constrained by the zipper. Alternatively, an entire side of one of the top gusset panels and the corresponding zipper base web can be sealed to the adjacent wall panel. This alternative arrangement essentially provides for a hinged zipper construction, which gives greater resistance to the zipper being separated by internal bag forces. The bottom gusset, comprising gusset panels 44 and 46 mutually connected at central fold line 22, is flattened by the weight of the scoopable product contained in the bag. This enables the package to sit squarely on a planar surface in an upright position without rolling or tipping over.

Figure 4:
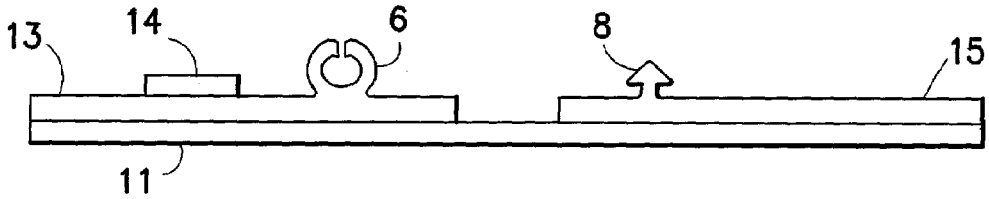
FIG. 4 is a schematic showing a cross-sectional view of one embodiment of a zipper tape that can be employed in the manufacture of the reclosable package shown in FIG. 5.

In the embodiment shown in FIGS. 3 and 4, the top gusset is joined to the base strip 4 along the entire lateral extent of the base strip. Alternatively, the top gusset could be joined to the base strip of the zipper only along the pull flanges. Preferably, the base strip 4 comprises a bottom layer of low-melting-point thermoplastic that melts at a temperature lower than the melting temperature of the bag material, so that during heat sealing of the zipper to the top gusset, the gusset panels will not be respectively heat sealed to the front and rear wall panels of the bag. Alternatively, the base strip can be attached to the gusset panels by adhesive or bonding strips.

The profiles of the closure elements of the zipper may take any form. For example, the zipper may comprise interlocking rib and groove elements or alternating hook-shaped closure elements.

The unopened package, as shown in FIG. 3, is airtight because the cap 12 covers the perforations 10 in the base strip. The package also possesses several tamper-evident features, including the perforated bag film and perforated zipper base strip, which must be torn open to gain access to the product; and the peel seal that, when ruptured, provides visible evidence of tampering.

A variety of methods exist for forming packages on various types of form-fill-seal machines. For example, a vertical form-fill-seal (VFFS) machine may be used to manufacture the packages described above. A thermoplastic film bag material is unrolled and fed downwardly over a forming collar and wrapped around a fill tube of the VFFS machine. The fill tube has a generally vertical axis. The longitudinal edges of the wrapped film are placed in abutting relationship and are joined by heat sealing to form a lap seal 40 (shown in FIGS. 3 and 4). The heat sealing is performed by a pair of opposing vertical heat sealing bars disposed adjacent the fill tube. The result is that the bag material has a generally tubular shape. Thereafter a line of perforations is formed in the bag material. The perforations run vertically along the tube of bag material. The perforations may be formed by a laser or by mechanical means.

The manufacturing process further comprises the step of unwinding a zipper tape from a spool, the zipper tape having the structure shown in FIG. 1. The bottom surface of the base strip of the zipper tape is pressed against the bag material (i.e., the closure elements point away from the bag material), the zipper tape being positioned with the line of perforations in the base strip overlying and generally aligned with a line of perforations in the bag material. Heat and pressure are applied to the base strip, e.g., by heat sealing bars. Preferably the base strip is a laminate, with a layer of low-melting-point sealing material in contact with a sealant layer of the bag material. As a result of the heat sealing operation, the unfolded zipper is joined to the outside of the bag material prior to the latter being formed into a tube.

The bag material is then wrapped around a tube and lapped edges are heat sealed by a pair of vertical sealing bars. Then the zipper tape section and adjoining bag material are folded inwardly to form the top gusset, while the diametrally opposite section of the tubular bag material is also folded inwardly to form the bottom gusset. Each gusset is formed by folding the bag material into a W-shape. In the case of the top gusset, the adjoining zipper is folded into a V-shape, with the folded zipper being captured between the two internal legs (i.e., gusset panels) of the aforementioned W-shaped gusset. Methods and apparatus for forming gussets are known. Typically, plow-shaped devices are used to gradually form the gussets as the bag material advances along the production line. In the present instance, such plows would be placed on opposite sides of the fill tube. For example, each side of the fill tube could be formed with a pair of plows separated by a space that is opposed by a stationary third plow. As the bag material advances down the fill tube, the plows guide the advancing bag material to adopt the aforementioned folded W-shape. Alternatively, in an intermittent gusset forming operation, extending and retracting gusset-forming plows can be used.

In the folded configuration, the gusset with the folded zipper captured between its panels is pressed together by another pair of opposing vertical sealing bars having a heated part and a non-heated part. The non-heated parts of the vertical sealing bars press the male and female closure elements of the zipper into interlocking engagement. The heated parts of the vertical sealing bars activate the peel seal material to form a peel seal, i.e., by joining the peel seal material to the opposing pull flange of the zipper, as seen in FIG. 2.

As the package advances further in the downward direction, the package is cross sealed by a pair of transverse heat sealing bars located below the fill tube output port. At the cross-sealing location, the ends of the zippers of successive packages are joined to the adjacent ends of the top gussets of the same packages. The zipper and bag material is also cut along a line that bisects the cross seal, thereby separating the previously filled package from the package about to be filled. The cross-sealed tubular package is then filled with product (e.g., detergent or flour) via the fill tube. The filled package is then advanced one package interval, following which the cross sealing and cutting operations are repeated. Optionally, the interior volume of the filled package can be evacuated before the package is closed by the second cross-sealing operation. In the second cross-sealing operation, the other end of the zipper of the filled package is joined to the adjacent end of the top gusset.

Figure 5:
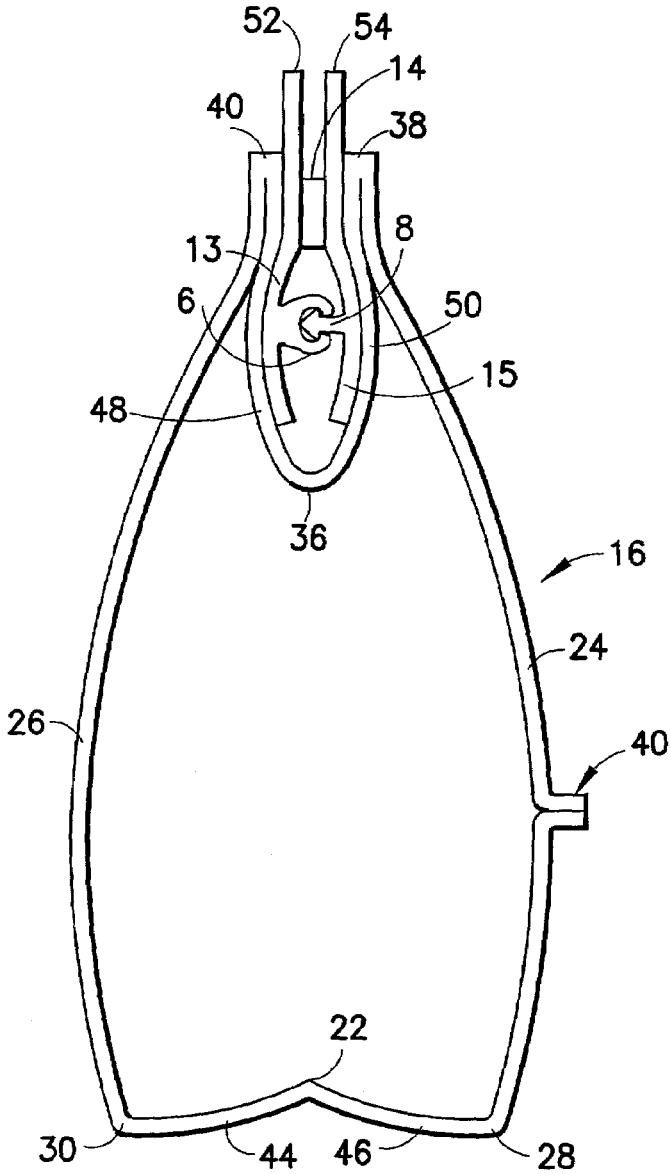
FIG. 5 is a schematic showing a cross-sectional view of a reclosable package manufactured using the zipper tape shown in FIG. 4.

Another embodiment of the invention is shown in FIGS. 4 and 5. FIG. 4 shows a zipper part 13 with a female profile 6 and a zipper part 15 with a male profile 8 extruded onto a carrier web 11, with a gap separating the two zipper parts. As previously described, a strip of peel seal material 14 is extruded onto either one of the zipper parts, layer 14 in this example being depicted on the base strip of zipper part 13. During package manufacturing, the carrier web is stripped away from the zipper parts, the latter being then heat sealed to the unformed bag material. After the bag has been formed into a tube, the gussets are formed as previously described. Again sealing bars press the male and female profiles into engagement and activate the peel seal 14, as seen in FIG. 5. Optionally, the bag material can be perforated or otherwise weakened along the line where fold line 36 will be formed, and a strip of capping material can be heat sealed to the bag material when the zipper parts are applied, the cap overlying the line of perforations in the area between the zipper parts.

Figure 6:
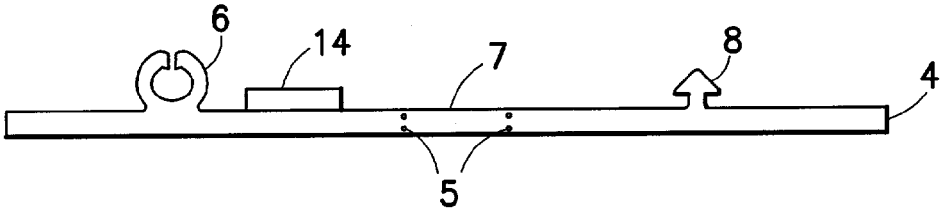
FIG. 6 is a schematic showing a cross-sectional view of a zipper in accordance with another embodiment of the invention.
Figure 7:
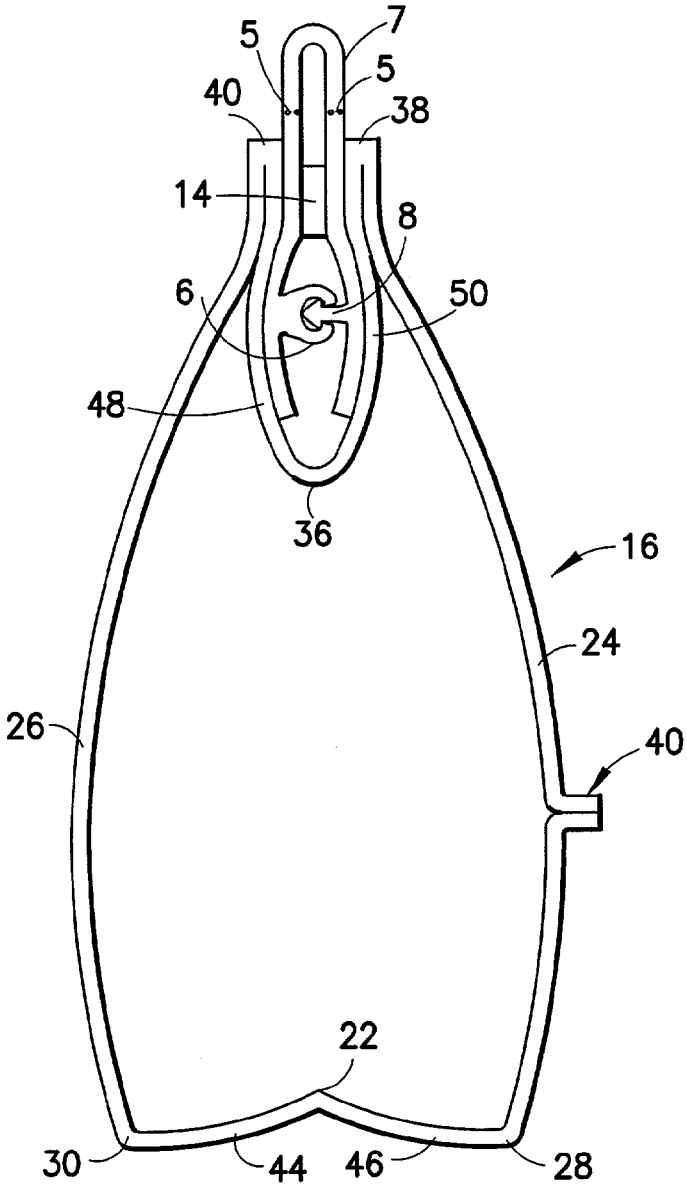
FIG. 7 is a schematic showing a cross-sectional view of a reclosable package incorporating the zipper shown in FIG. 6.

Another embodiment of the invention is shown in FIGS. 6 and 7. FIG. 6 shows a zipper tape 2 comprising planar base strip 4, a closure element 6 having a female profile and a closure element 8 having a male profile. The male and female profiles are designed to interlock when the zipper is folded. A strip of peel seal material 14 is extruded onto an off-center portion of the base strip that lies between the male and female profiles. In the central portion 7 of the base strip 4, a pair of parallel lines of perforations 5 are formed after extrusion, these lines of perforations 5 preferably being equidistant from and on opposite sides of a centerline of the base strip. The base strip is then folded along the centerline. Thereafter the folded base strip is pressed between sealing bars having a heated part for activating the peel seal and a non-heated part for pressing the male and female closure elements of the zipper into interlocking engagement. This zipper tape is then wound on a spool. During package manufacture, bag material is wrapped around a tube and heat sealed at adjoining edges to form a tubular shape. Then gussets are formed in diametrally opposite portions of the tube. The zipper tape is unwound from the spool, fed between the gusset panels of the top gusset in an inverted position and then heat sealed to the top gusset panels with the central portion of base strip projecting out of the top gusset, as seen in FIG. 7. The zipper can be opened by tearing along the lines of perforations 5 and removing the central portion 7 of the base strip. This construction, with the zipper fold outside the bag, provides a tamper-evident feature. Optionally, the bag material can be perforated or otherwise weakened along fold line 36 and a strip of capping material can be heat sealed to the bag material before the latter is formed into a tube.

While the invention has been described with reference to preferred embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the term "package" means a container, bag, pouch or other receptacle for objects, material or stuff. A container, bag, pouch or other receptacle is deemed to be a package even if not yet packed with objects, material or stuff. As used in the claims, the verb "joined"

means fused, bonded, sealed, adhered, etc., whether by application of heat and/or pressure, application of ultrasonic energy, application of a layer of adhesive material or bonding agent, interposition of an adhesive or bonding strip, etc.

The invention claimed is:

1. A package comprising:

a receptacle having an enclosed interior volume, wherein said receptacle comprises first and second walls and first and second gussets, said first and second gussets being disposed on opposing sides of said receptacle, said first gusset comprising first and second gusset panels, said first and second gusset panels being connected to each other at a fold in said first gusset, said first gusset panel being connected to a top portion of said first wall at a first top fold, and said second gusset panel being connected to a top portion of said second wall at a second top fold, and said second gusset comprising third and fourth gusset panels, said third and fourth gusset panels being connected to each other at a fold in said second gusset, said third gusset panel being connected to a bottom portion of said first wall at a first bottom fold, and said fourth gusset panel being connected to a bottom portion of said second wall at a second bottom fold, said first wall extending from said first top fold to said first bottom fold without a zone in which one portion of said first wall is joined to another portion of said first wall, and a flexible zipper comprising a folded web and first and second mutually interlocked profiled closure members integrally formed with and disposed inside said folded web, wherein said first gusset is joined to said folded web over the entire area of said first gusset, a first portion of said folded web being disposed between said first and second gusset panels.

2. The package as recited in claim 1, wherein said folded web further comprises second and third portions that project outside of said receptacle and serve as pull flanges for pulling open said zipper.

3. The package as recited in claim 2, further comprising a band of peel seal material having opposite sides thereof joined to the same side of said folded web at respective portions of said folded web that are disposed in opposition to each other, said portion of said folded web that is joined to one side of said band of peel seal material being located between said first pull flange and said first profiled closure member, and said portion of said folded web that is joined to the opposite side of said band of peel seal material being located between said second pull flange and said second profiled closure member.

4. The package as recited in claim 1, wherein said folded web has a multiplicity of perforations disposed along its fold.

5. The package as recited in claim 4, further comprising a layer of material that is joined to said folded web and caps said perforations in said folded web.

6. The package as recited in claim 4, wherein said first gusset has a multiplicity of perforations disposed along its fold.

* * * * *